US005672071A

United States Patent [19]

Ceru

[11] Patent Number: 5,672,071

[45] Date of Patent: Sep. 30, 1997

[54] ELECTRICAL CONNECTOR WITH GUARDED LATCH

[75] Inventor: Scott Joseph Ceru, Farmington Hills, Mich.

[73] Assignee: Yazaki Corporation, Tokyo, Japan

[21] Appl. No.: 574,075

[22] Filed: Dec. 18, 1995

[51] Int. Cl.[6] ..... H01R 13/627

[52] U.S. Cl. ..... 437/353; 439/352

[58] Field of Search ..... 439/350, 351, 439/352, 353, 354, 355, 357, 358, 445, 447, 452

[56] References Cited

U.S. PATENT DOCUMENTS 5,399,045 3/1995 Yoneda et al. ..... 439/352
5,462,457 10/1995 Schroepfer et al. ..... 439/352

FOREIGN PATENT DOCUMENTS 218936 5/1990 Japan .

*Primary Examiner*—Hien Vu
*Attorney, Agent, or Firm*—Young & Basile, P.C.

[57] ABSTRACT

An electrical connector for wiring harnesses and other electrical devices has a latch to hold the connector in engagement with a mating connector and side and top guards to guard against inadvertent release of the latch. The guards also serve to prevent wires or other foreign objects from becoming entangled with the latch during shipping and handling.

12 Claims, 2 Drawing Sheets

46
12
16
28
24
32
36
42
36
38
26
40
32
30
34
42
18
18
16
26
14
10
38
20
34
40

36
36
38
26
26
40
34
42
24
38
34
40
12
20
10
18
18

ELECTRICAL CONNECTOR WITH GUARDED LATCH

FIELD OF THE INVENTION

This invention relates to electrical connectors having latching means for holding the connectors in secure engagement with a mating connector, and more specifically to a connector having a latching arm and means for preventing inadvertent release of the latching arm from engagement with the mating connector.

BACKGROUND OF THE INVENTION

Electrical connectors are widely used in the automotive industry to detachably interconnect and provide electrical continuity between wiring harnesses and various other electrical components. A representative electrical connector comprises a plurality of electrical terminals or contacts held by a nonconductive connector body adapted to physically engage a mating connector to place the terminals in electrical contact with corresponding terminals of the mating connector. It is common for such mating pairs of connectors to include some form of latching means whereby they may be secured in engagement with one another once in a properly mated relationship. Such latching means serve to ensure that the connector pairs remain positively mated during use and are not inadvertently disconnected by, for example, vibration or incidental contact with other objects during use or maintenance.

It is sometimes necessary, for example in the course of the repair or replacement of a defective component, to intentionally disconnect an electrical connector from its mating connector. For this reason it is necessary that the latching means be disengagable and, preferably, that disengagement be possible without the use of tools. Some prior electrical connector designs have, therefore, featured latches that are spring biased toward full engagement but easily unlatched by squeezing or pressing on the connector or some portion thereof with one's fingers to overcome the biasing force.

It is apparent that a trade-off exists between ease of intentional unlatching by a worker on the one hand and resistance to inadvertent unlatching on the other. To be easily manually unlatched by a worker, the portion of the connector that is actuated should be (a) large enough to be grasped by the average worker's fingertips, (b) located and configured to provide unobstructed access by the worker, and (c) actuatable with a minimum of effort. These same features, however, increase the likelihood that the connector may be inadvertently unlatched during operational use or shipping.

One prior art latchable connector features a latching arm attached at one end to the exterior surface of the connector and extending in a cantilever fashion substantially parallel with the surface. In its normally biased condition the latching arm, due to its inherent stiffness or to a separate spring, stands away from the connector surface by a small amount. In this position, detent means on the latching arm is in latched engagement with cooperating detent means on the mating connector when the two connectors are properly joined. To release the detent means of the two connectors from latched engagement with one another the latching arm is depressed, forcing it toward the connector surface. Although quite easily and quickly releasable by a worker, it is also possible for such a latching arm to be depressed inadvertently in its operating environment where other objects may press or rub against it.

In order to decrease the likelihood of the latching arm being inadvertently depressed, the connector described above has been modified to include small plates that extend from the connector surface in close proximity to either side of the free end of the latching arm. These side guards extend upward at least to the level of the highest point of the latching arm, thereby obstructing access to the arm so that an object must fit between the side guards in order to depress the latching arm. For ease of actuation by a worker, the side guards must be spaced far enough apart for an average sized adult worker's fingertip to fit therebetween and press down on the latching arm. Spacing the side guards widely enough for comfortable actuation of the latching arm by a worker, though, can make the latching arm undesirably susceptible to inadvertent actuation.

It has also been found that an electrical connector featuring a latching arm as described above may be damaged during shipping. Electrical connectors are commonly assembled as part of a wiring harness, and one or more harnesses are then packed loosely in a carton for shipping to a location where subsequent component assembly takes place. The vibration and jostling that occurs during shipping and handling of the carton can cause the wires that make up the harnesses to work their way underneath the latching arm, into the gap between the connector body and the arm. If a connector becomes snagged on the harness wiring in this fashion, the latching arm may break off of the connector or be otherwise damaged when the harnesses are pulled out of the carton.

Therefore, it would be desirable to provide a means by which the latching arm of a latchable connector as described above is guarded against being inadvertently depressed and also against snagging on wires or other objects.

SUMMARY OF THE INVENTION

The present invention is directed toward an electrical connector for containing a plurality of terminals and releasably securing the terminals in electrical contact with respective terminals of a mating connector, wherein the electrical connector includes latching means to maintain the connectors in physical engagement with one another. The connector includes a body for enclosing the terminals, and the latching means is attached to the exterior of the body and is movable from a latched position to an unlatched position by the application of a release force to the latching means.

According to a feature of the invention, first and second latch guards extend from the body and substantially encircle the latching means such that they obstruct contact with the latching means that would tend to move it to the unlatched position. The latch guards are movable to a release condition wherein they apply the release force to the latching means. The latch guards accordingly protect against inadvertent contact with the latch means which may result in unlatching of the connector from the mating connector, while providing a mechanism by which unlatching may be readily achieved by a worker when desired, regardless of the size of the worker's fingers. The latch guards also help to prevent wires or other foreign objects from working their way into the space between the connector body and the latch means during shipping and handling of a wiring harness, and thus protect against damage to the connector.

According to another feature of the invention, the first and second latch guards comprise first and second side guards extending from the body on opposite sides of the latching means, and first and second top guards extending from respective side guards toward one another into a position obstructing access to the surface of the latching means on which the release force must be applied. The side guards inhibit intrusion of foreign objects into the space between the body and the latching means, and the top guards obstruct contact with the latching means.

According to yet another feature of the invention, movement of the latch guards to the release condition is accomplished by urging the side guards toward one another such that the side guards contact the latching means and apply the release force thereto. This allows the connector to be unlatched by the application of a squeezing force to the outside of the connector, an action that is easily performed by a worker regardless of his/her manual dexterity or finger size relative to the size of the latching means.

According to a further feature of the invention, the side guards include release projections extending therefrom and having respective first and second ends distal from the side guards, and the latching means has first and second contact surfaces, the first and second ends being proximate the first and second contact surfaces respectively when the latching means is in the latched position and the side guards are in the undeflected condition, and the ends contacting respective contact surfaces to apply the release force thereto when the side guards are moved to the release condition.

According to a still further feature of the invention, the movement of the latch mechanism from the latched position to the unlatched position is along a first axis and the movement of the side guards from the undeflected condition to the release condition is along a second axis substantially perpendicular to the first axis, and the contact between the first release projection end and the first contact surface is at a first angle oblique to both the first axis and the second axis, and the contact between the second release projection end and the second contact surface is at a second angle oblique to both the first axis and the second axis. Because of the oblique orientation of the angles of contact, movement of the side guards to the released condition results in application of force to the latch means such as to move it along the first axis.

According to still another feature of the invention, the first and second contact surfaces are substantially planar and lie at the first and second angles respectively, and the first release projection end has a surface substantially parallel with the first contact surface, and the second release projection end has a surface substantially parallel with the second contact surface. Positive contact between the release projection ends and their respective contact surfaces is thus assured when the side guards are urged together, and the transfer of force to the latch means moves it to its unlatched position.

According to a further feature of the invention, the top guards are offset from one another along a line substantially perpendicular to the direction of movement of the latch guards from the undeflected condition to the release condition. This offset ensures that when the side guards are moved toward one another from the undeflected condition to the release condition the top guards do not contact one another so as to significantly interfere with the movement of the side guards toward one another.

According to a still further feature of the invention, the side guards include grip surfaces to facilitate the urging of the side guards toward one another.

DETAILED DESCRIPTION OF THE PREFERRED EMBODIMENT

Figure 1:
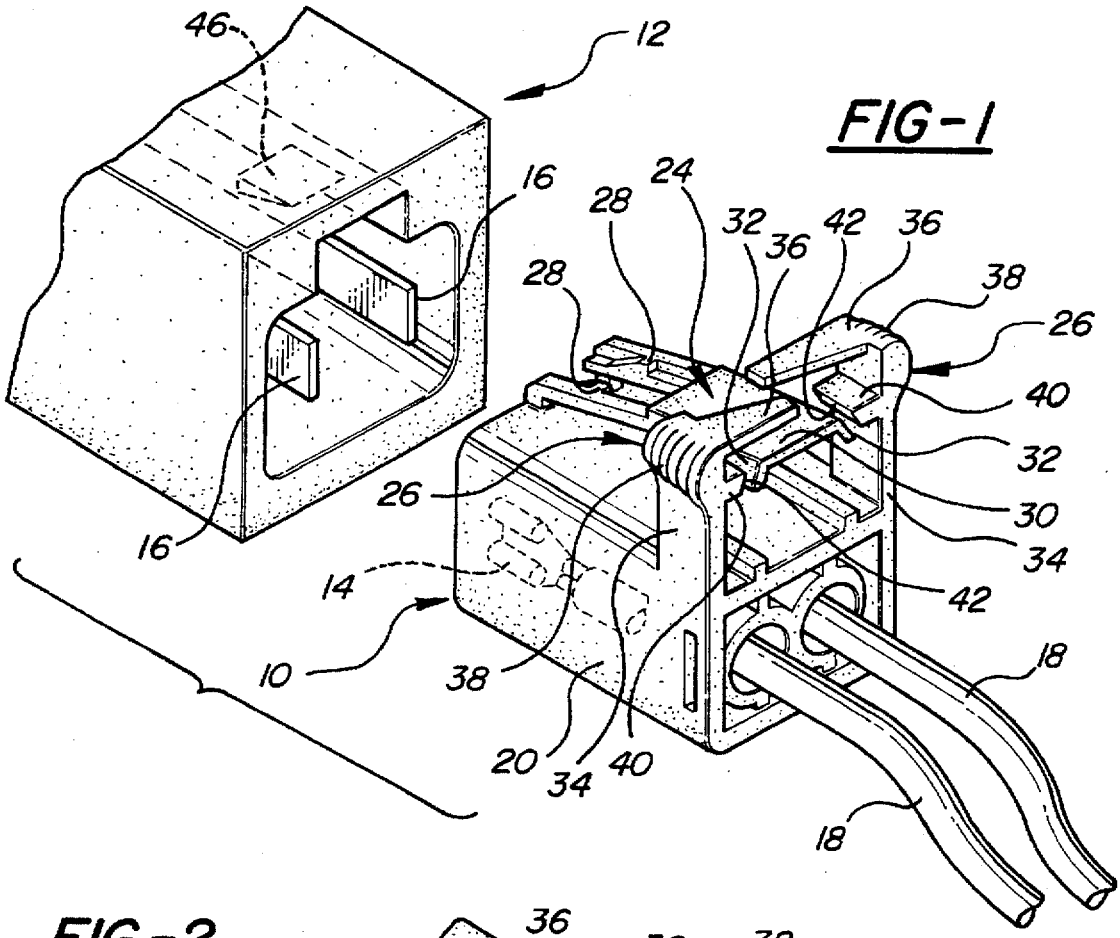
FIG. 1 is a perspective view of an electrical connector according to the present invention and a mating connector.
Figure 2:
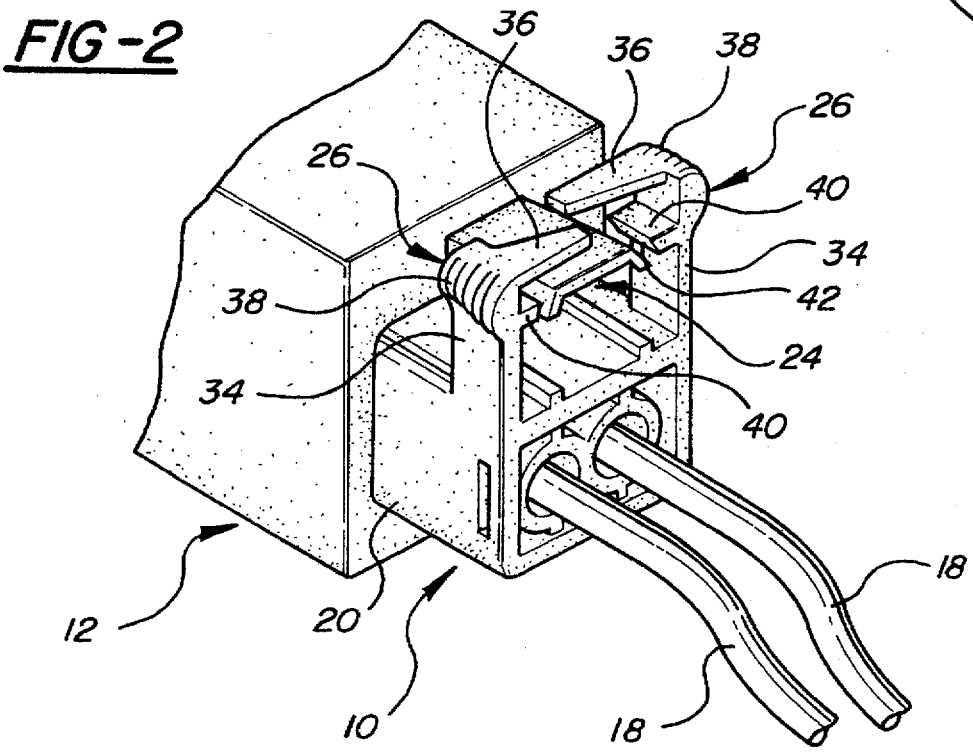
FIG. 2 is a perspective view of the electrical connector and mating connectors of FIG. 1 in latching engagement with one another.

As seen in FIGS. 1 and 2, a male electrical connector 10 according to the present invention is adapted for insertion into a mating female connector 12 to achieve electrical contact between parallel, axial terminals 14 retained inside of connector 10 and correspondingly arranged, complemental terminals 16 inside of mating connector 12. Connector 10 is depicted as the terminating component of a wiring harness made up of multiple insulated wires 18, and mating connector 12 may likewise be part of a wiring harness or of another electrical component such as an alternator.

Connector 10 is preferably injection molded as a single piece of plastic material such as polybutylteraethylene (PBT) and comprises a body 20 having internal cavities for retaining terminals 14, a latching arm 24 attached to the body at one end and extending substantially parallel to the top surface of the body in a cantilever fashion, and latch guards 26 extending from the body to partially encircle the free end of latching arm 24.

Wedge-shaped latch pawls 28 are formed on the upper side of latching arm 24 at approximately mid-length, and the free end of the latching arm widens to form a push button 30. Both outer edges of push button 30 are chamfered at an angle of approximately 45 degrees from the vertical, with the chamfers constituting contact surfaces 32.

Latch guards 26 comprise side guards 34 protruding substantially perpendicularly upward from the lateral extremes of body 20 to bracket push button 30 on either side, and top guards 36 extending inwardly from respective side guards to pass over the top surface of the push button. The juncture between each side guard 34 and its respective top guard 36 is of increased thickness to form an outwardly bulging grip surface 38 having a ridged or otherwise textured surface.

Each side guard 34 includes a release projection 40 extending inwardly therefrom immediately below the respective top guard 36 to position a bevelled end 42 in close proximity to its adjacent contact surface 32. The surface of each bevelled end 42 is formed at an angle complementary to that of the adjacent contact surfaces 32, i.e. the bevelled ends are substantially parallel to the contact surfaces.

Figure 3:
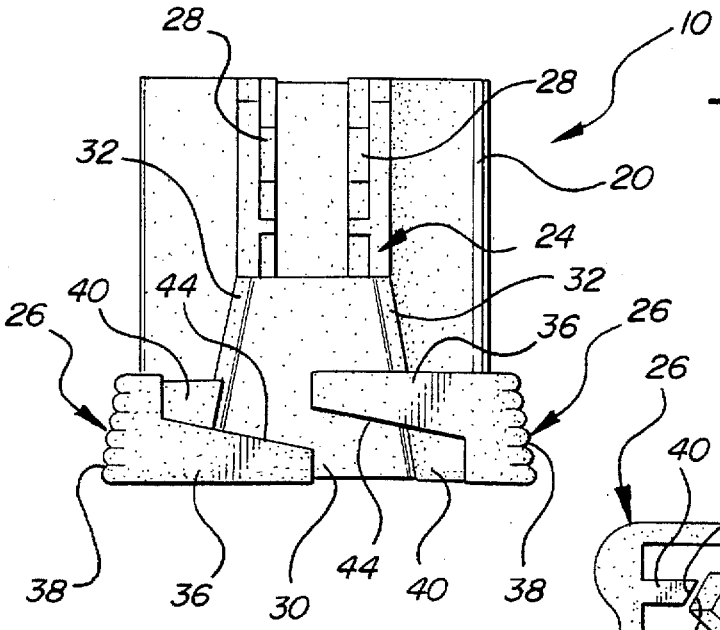
FIG. 3 is a top view of the invention electrical connector in an undeflected or engaged condition.
Figure 4:
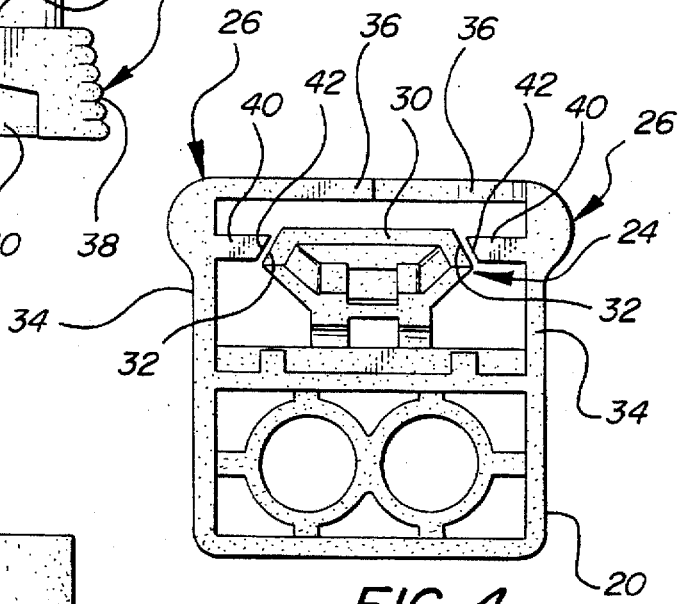
FIG. 4 is an end view of the invention electrical connector in an undeflected or engaged condition.

As can best be seen in FIG. 3, each top guard 36 extends inwardly to approximately the longitudinal centerline of push button 30, and the proximate edges 44 of the top guards are angled with respect to the lateral axis of connector 10. This angling results in top guards 36 being offset or staggered with respect to one another along the longitudinal axis of connector 10.

Latching arm 24 is molded to naturally maintain a latched position wherein it stands somewhat away from the upper surface of body 20. As connector 10 is inserted into mating connector 12, interference between latching arm 24 and the inner surface of the mating connector forces the latching arm downward toward an unlatched position. The wedge shape of latch pawls 28 is oriented so as to permit sliding movement of connector 10 into mating connector 12. A detent tooth 46 formed in the upper, inner surface of mating connector 12 is positioned such that latch pawls 28 are in alignment with the detent when connector 10 is inserted fully into mating connector 12. When latch pawls 28 are aligned with tooth 46, latching arm 24 returns to its latched condition, thus urging the latch pawl into engagement with the tooth. This engagement holds connector 10 securely latched inside of mating connector 12 in spite of vibration or other forces tending to pull the mated connectors apart.

In order to remove connector 10 from mating connector 12, latching arm 24 must be depressed to the unlatched position wherein latch pawls 28 are disengaged from tooth 46. Latch guards 26, in their natural, undeflected condition shown in FIGS. 1 through 4, wrap around the sides and top of push button 30 to obstruct contact with the upper surface of the push button such as may tend to force the arm downward to the unlatched position, and accordingly the latch guards inhibit accidental or unintended release of the latch. By substantially encircling latching arm 24, latch guards 26 also lessen the possibility of wires or other objects working their way into the gap between connector body 20 and the arm during shipping and handling of a wiring harness including connector 10, and thus protect against damage to the connector.

Figure 5:
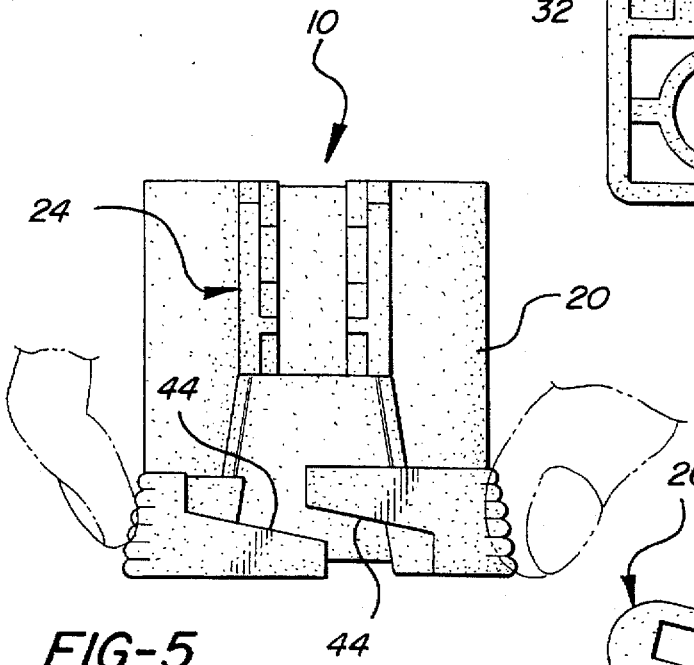
FIG. 5 is a top view of the invention electrical connector in a deflected or released condition.
Figure 6:
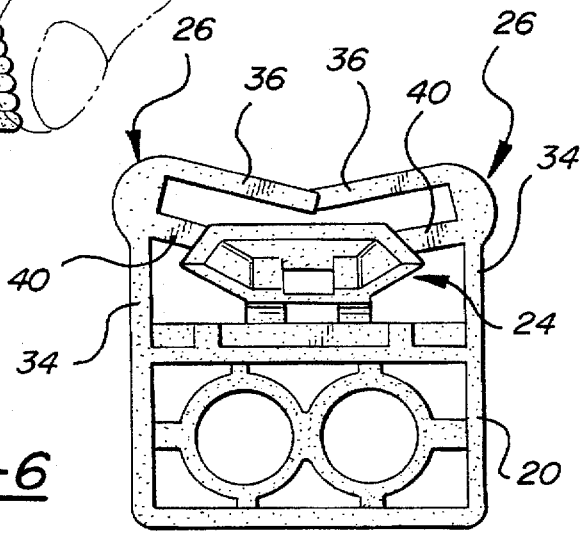
FIG. 6 is an end view of the invention electrical connector in a deflected or released condition.

When it is desired to separate connector 10 from mating connector 12, an inwardly directed pressure is applied to grip surfaces 38, for example with a thumb and forefinger as indicated in FIG. 5. This inward pressure moves latch guards 26 from their at-rest, undeflected condition shown in FIGS. 1 through 4 to a release condition shown in FIGS. 5 and 6. In the release condition, release projections 40 are moved inward such that their bevelled ends 42 press against respective contact surfaces 32 on push button 30. As side guards 34 deflect inwardly, they rotate slightly so that bevelled ends 42 of release projections 40 move downward and inward as seen in FIG. 6. This downward movement, combined with the angled interface between bevelled ends 42 and contact surfaces 32, translates the inward movement of release projections 40 into a downward release force applied to push button 30 so that latching arm 24 is depressed to the unlatched position.

The outwardly bulging shape and textured surfaces of grip surfaces 38 make it easier for a person to get a secure grip on latch guards 26, and also provides the person with a tactile indication of where the squeezing force should be applied. Such a tactile indication may be valuable if connector 10 is in a location where it can not easily be seen by the person seeking to release it from connection with mating connector 12.

As top guards 36 move inwardly to the release condition, the longitudinal offset or stagger between the top guards allows them to move past one another into the relationship shown in FIGS. 5 and 6 rather than butting up against each other in a manner that would interfere with movement of side guards 34 as would otherwise be the case.

It is therefore seen that the present invention provides an electrical connector that is resistant to accidental unlatching by virtue of latch guards 26 inhibiting contact with latching arm 24 yet may still be conveniently opened when necessary by application of a squeezing force on the outside of the latch guards.

Whereas a preferred embodiment of the invention has been illustrated and described in detail, it will be apparent that various changes may be made in the disclosed embodiment without departing from the scope or spirit of the invention.

I claim:

1. An electrical connector including a body and latching means attached to the body, the latching means movable from a latched position to an unlatched position by application of a release force to the latching means, the electrical connector characterized in that:

first and second discrete latch guards are disposed on the body and have an undeflected condition wherein they substantially encircle the latching means to thereby obstruct contact with the latching means, the first and second latch guards comprising respective first and second discrete side guards extending from the body on respective first and second opposite sides of the latching means and respective first and second discrete top guards extending from the first and second side guards and substantially toward one another into proximity with the latching means, the first and second side guards being urgable from the undeflected condition toward one another to a release condition and at least one of the side guards including projecting means for contacting the latching means to apply the release force thereto when the side guards are urged to the release condition to thereby apply the release force to the latching means.

2. An electrical connector according to claim 1 wherein the projecting means comprises first and second release projections extending from the first and second side guards respectively and having respective first and second ends distal from the side guards, and the latching means has first and second contact surfaces, the first and second ends being proximate the first and second contact surfaces respectively when the latching means is in the latched position and the side guards are in the undeflected condition, and movement of the side guards to the release condition placing the first and second release projection ends in contact with the first and second contact surfaces respectively to apply the release force thereto.

3. An electrical connector according to claim 2 wherein the movement of the latching means from the latched position to the unlatched position is substantially along a first axis and the movement of the side guards from the undeflected condition to the release condition is substantially along a second axis substantially perpendicular to the first axis, and the contact between the first release projection end and the first contact surface is at a first angle oblique to both the first axis and the second axis, and the contact between the second release projection end and the second contact surface is at a second angle oblique to both the first axis and the second axis, whereby movement of the side guards along the second axis applies force to the latching means tending to move it along the first axis.

4. An electrical connector according to claim 3 wherein the first and second contact surfaces are substantially planar and lie at the first and second angles respectively, and the first release projection end has a surface substantially parallel with the first contact surface, and the second release projection end has a surface substantially parallel with the second contact surface.

5. An electrical connector according to claim 1 wherein the top guards are offset from one another along a line substantially perpendicular to the direction of movement of the latch guards from the undeflected condition to the release condition, whereby when the side guards are moved toward one another from the undeflected condition to the release condition the top guards do not contact one another so as to significantly interfere with the movement of the side guards toward one another.

6. An electrical connector according to claim 1 wherein the side guards include grip surfaces to facilitate the urging of the side guards toward one another.

7. An electrical connector for releasably maintaining a plurality of terminals in electrical contact with respective mating terminals of a mating connector, the connector comprising:

a body for internally receiving the plurality of terminals;

latching means disposed on the body and movable between a latched position wherein the latching means is engaged with mating latching means of the mating connector and an unlatched position wherein the latching means is disengaged from the mating latching means, movement of the latching means from the latched position to the unlatched position achievable by application of a release force to a surface of the latching means;

first and second discrete side guards extending from the body on opposite sides of the latching means, at least one of the side guards including projecting means for contacting the latching means; and first and second discrete top guards extending from the first and second side guards respectively and substantially toward one another to be proximate to the surface of the latching means;

the first and second side guards having an undeflected condition wherein they substantially encircle the latching means to thereby obstruct contact with the latching means, and being movable substantially toward one another to a release condition wherein the projecting means applies the release force to the latching means.

8. An electrical connector comprising:

a body;

latching means disposed on the body, the latching means movable from a latched position to an unlatched position by application of a release force to the latching means, and the latching means has first and second contact surfaces;

first and second discrete side guards extending from the body adjacent the latching means on opposite sides of the latching means;

first and second discrete top guards extending from the first and second side guards respectively and substantially toward one another into proximity with the latching means;

first and second release projections extending from the first and second side guards respectively and having respective first and second ends distal from the side guards, the first and second ends being proximate the first and second contact surfaces respectively when the latching means is in the latched position and the side guards are in an undeflected condition, and urging of the side guards toward one another placing the first and second release projection ends in contact with the first and second contact surfaces respectively to apply the release force thereto.

9. Art electrical connector according to claim 8 wherein the movement of the latching means from the latched position to the unlatched position is substantially along a first axis and the movement of the side guards from the undeflected condition to the release condition is substantially along a second axis substantially perpendicular to the first axis, and the contact between the first release projection end and the first contact surface is at a first angle oblique to both the first axis and the second axis, and the contact between the second release projection end and the second contact surface is at a second angle oblique to both the first axis and the second axis, whereby movement of the side guards along the second axis applies force to the latching means tending to move it along the first axis.

10. An electrical connector according to claim 9 wherein the first and second contact surfaces are substantially planar and lie at the first and second angles respectively, and the first release projection end has a surface substantially parallel with the first contact surface, and the second release projection end has a surface substantially parallel with the second contact surface.

11. An electrical connector comprising:

a body;

latching means disposed on the body, the latching means movable from a latched position to an unlatched position by application of a release force to the latching means;

first and second discrete side guards extending from the body adjacent the latching means on opposite sides of the latching means, the side guards being urgable from an undeflected condition toward one another to a release condition wherein the side guards contact the latch means to apply the release force thereto; and first and second discrete top guards extending from the first and second side guards respectively and substantially toward one another into proximity with the latching means, the top guards being offset from one another along a line substantially perpendicular to the direction of movement of the side guards from the undeflected condition to the release condition, whereby when the side guards are moved from the undeflected condition to the release condition the top guards do not contact one another so as to significantly interfere with the movement of the side guards toward one another.

12. An electrical connector including a body, latching means disposed on the body and movable from a latched position to an unlatched position by application of a release force to the latching means, and first and second latch guards disposed on the body and having an undeflected condition wherein they substantially encircle the latching means to thereby obstruct contact with the latching means and being movable by manual force from the undeflected condition to a release condition wherein they apply the release force to the latching means, the first and second latch guards comprising respectively:

first and second discrete side guards extending from the body adjacent the latching means and on first and second opposite sides of the latching means respectively, and including grip surfaces to facilitate the urging of the side guards toward one another; and first and second discrete top guards extending from the first and second side guards respectively and substantially toward one another into proximity with the latching means, movement of the latch guards to the release condition being accomplished by urging the side guards toward one another, said movement causing the side guards to contact the latching means and apply the release force to the latching means.

* * * * *